US009101198B2

(12) United States Patent
Tseng

(10) Patent No.: US 9,101,198 B2
(45) Date of Patent: Aug. 11, 2015

(54) QUICK RELEASE ASSEMBLY FOR LAW ENFORCEMENT EQUIPMENT

(71) Applicant: Jui-Fu Tseng, Yilan (TW)

(72) Inventor: Jui-Fu Tseng, Yilan (TW)

(73) Assignee: STARJET Technologies Co., LTD, Jintan (CN)

( * ) Notice: Subject to any disclaimer, the term of this patent is extended or adjusted under 35 U.S.C. 154(b) by 64 days.

(21) Appl. No.: 14/102,464

(22) Filed: Dec. 10, 2013

(65) Prior Publication Data

US 2015/0157118 A1 Jun. 11, 2015

(51) Int. Cl.
*A45F 5/02* (2006.01)

(52) U.S. Cl.
CPC ..... *A45F 5/02* (2013.01); *A45F 2005/025* (2013.01); *A45F 2200/0566* (2013.01); *Y10T 24/1391* (2015.01); *Y10T 24/1394* (2015.01); *Y10T 403/592* (2015.01)

(58) Field of Classification Search
USPC ..... 224/200, 914, 671, 672, 676, 197, 660, 224/663, 665
See application file for complete search history.

(56) References Cited

U.S. PATENT DOCUMENTS

| | | | | |
|---|---|---|---|---|
| 6,736,136 | B2 * | 5/2004 | Chen-Lieh | 128/201.11 |
| 8,613,564 | B2 * | 12/2013 | Busch | 403/322.1 |
| 8,919,622 | B1 * | 12/2014 | Gabriel et al. | 224/148.4 |
| 2003/0042279 | A1 * | 3/2003 | Locklear, III | 224/244 |
| 2006/0246963 | A1 * | 11/2006 | Tages | 455/575.1 |
| 2010/0071168 | A1 * | 3/2010 | Miller | 24/3.11 |

* cited by examiner

*Primary Examiner* — Robert J Sandy
*Assistant Examiner* — Matthieu Setliff

(57) ABSTRACT

A quick release assembly is provided with a plate member including two bent end loops; an inner plate including a longitudinal channel, a lateral receptacle communicating with the longitudinal channel, and a through hole; a shuttle in the longitudinal channel, an upper tunnel on an edge, a lower tunnel, a lug in the through hole, a slot through the lug, an upper narrow hole in the slot, and a lower circular hole in the slot; a first spring actuated detent in the lateral receptacle and having one end urging against either the upper tunnel or the lower tunnel; an outer plate including a longitudinal recess, and a hole member through the longitudinal recess; a lock mechanism partially disposed in the longitudinal recess and including a lever and a concave part; and a second spring actuated detent in the through hole, the slot, the hole member, and the concave part.

1 Claim, 7 Drawing Sheets

QUICK RELEASE ASSEMBLY FOR LAW ENFORCEMENT EQUIPMENT

BACKGROUND OF THE INVENTION

1. Field of the Invention

The invention relates to quick releases and more particularly to a quick release assembly for law enforcement equipment such as baton, the quick release assembly adapted to lock by pushing down a shuttle or unlock by pushing up the shuttle.

2. Description of Related Art

A conventional system for carrying and rapidly accessing implements carried on a belt used by law enforcement officers is provided. The system uses a hinged floor carried on a flat plate having a belt loop. The hinged floor is held perpendicular to the flat plate by a strap having a quick-release latch at the top. When the strap is released the floor drops to form an angle with the flat plate so as to allow a user to quickly remove the implement using one hand.

While it has some utility, improvements in these products are desired, and these improvements are provided by the invention.

SUMMARY OF THE INVENTION

It is therefore one object of the invention to provide a quick release assembly comprising a rectangular plate member comprising two bent loops at both ends respectively; two slidable fasteners each disposed in the loop; a rectangular inner plate comprising a longitudinal channel adjacent to one side, a lateral receptacle communicating with the longitudinal channel, and a through hole under the lateral receptacle communicating with the longitudinal channel; a shuttle moveably disposed in the longitudinal channel, an upper tunnel formed on an edge opposite to the lateral receptacle, a lower tunnel opposite to the lateral receptacle, a lug under the lower tunnel and disposed in the through hole, a slot through the lug, a narrow hole on an upper portion of the slot, and a circular hole on a lower portion of the slot and communicating with the narrow hole; a first spring actuated detent disposed in the lateral receptacle and having one end urging against either the upper tunnel or the lower tunnel; a rectangular outer plate comprising a longitudinal recess, and a hole member through the longitudinal recess; a lock mechanism partially disposed in the longitudinal recess and comprising a lever and a concave part facing the slot; and a second spring actuated detent disposed in the through hole, the slot, the hole member, and the concave part; wherein in a locked state, the first spring actuated detent disposed is in the upper tunnel and the second spring actuated detent is disposed in the narrow hole; and wherein in an unlocked state, the first spring actuated detent disposed is in the lower tunnel and the second spring actuated detent is disposed in the circular hole so that a pushing up of the lever causes the concave part to push the second spring actuated detent inward to unlock the lock mechanism.

The above and other objects, features and advantages of the invention will become apparent from the following detailed description taken with the accompanying drawings.

BRIEF DESCRIPTION OF THE DRAWINGS

FIG. 3 is another perspective view of the lock mechanism shown in FIG. 2;

DETAILED DESCRIPTION OF THE INVENTION

Figure 1:
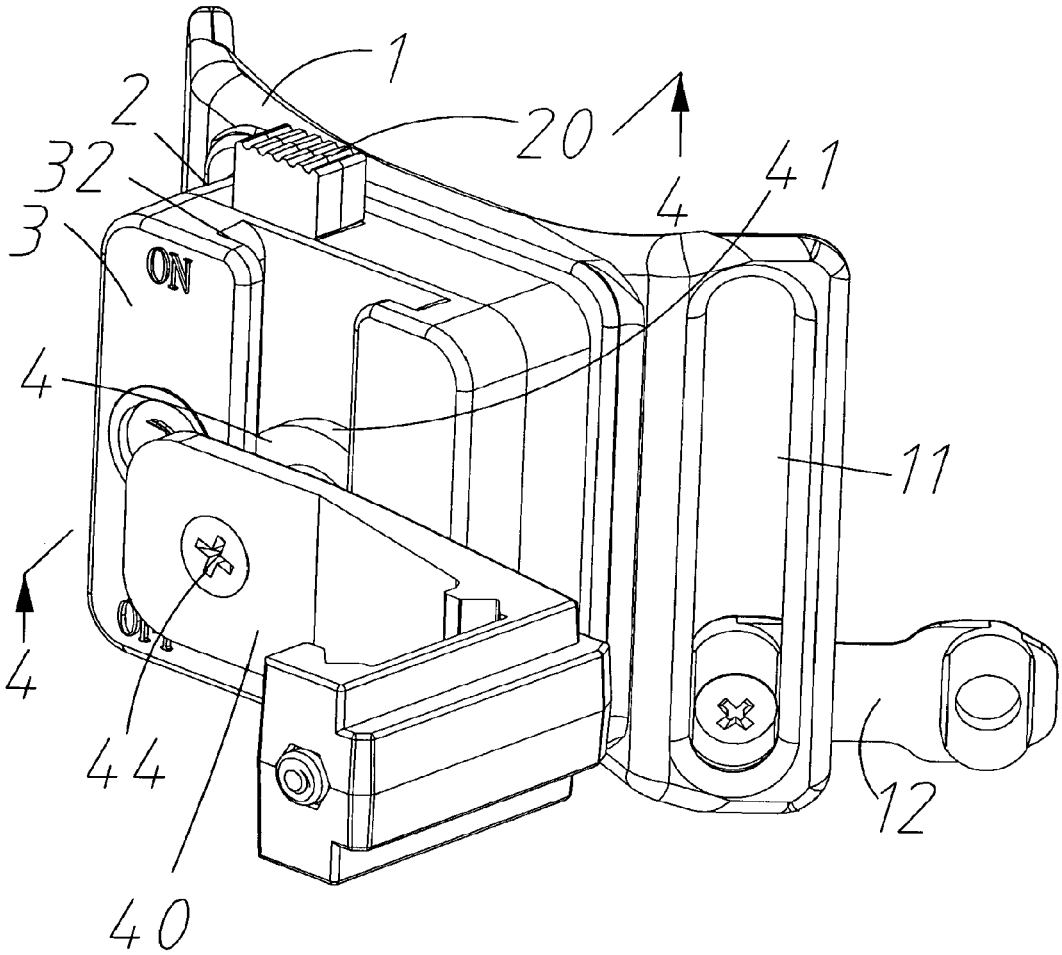
FIG. 1 is a perspective view of a quick release assembly according to the invention.
Figure 2:
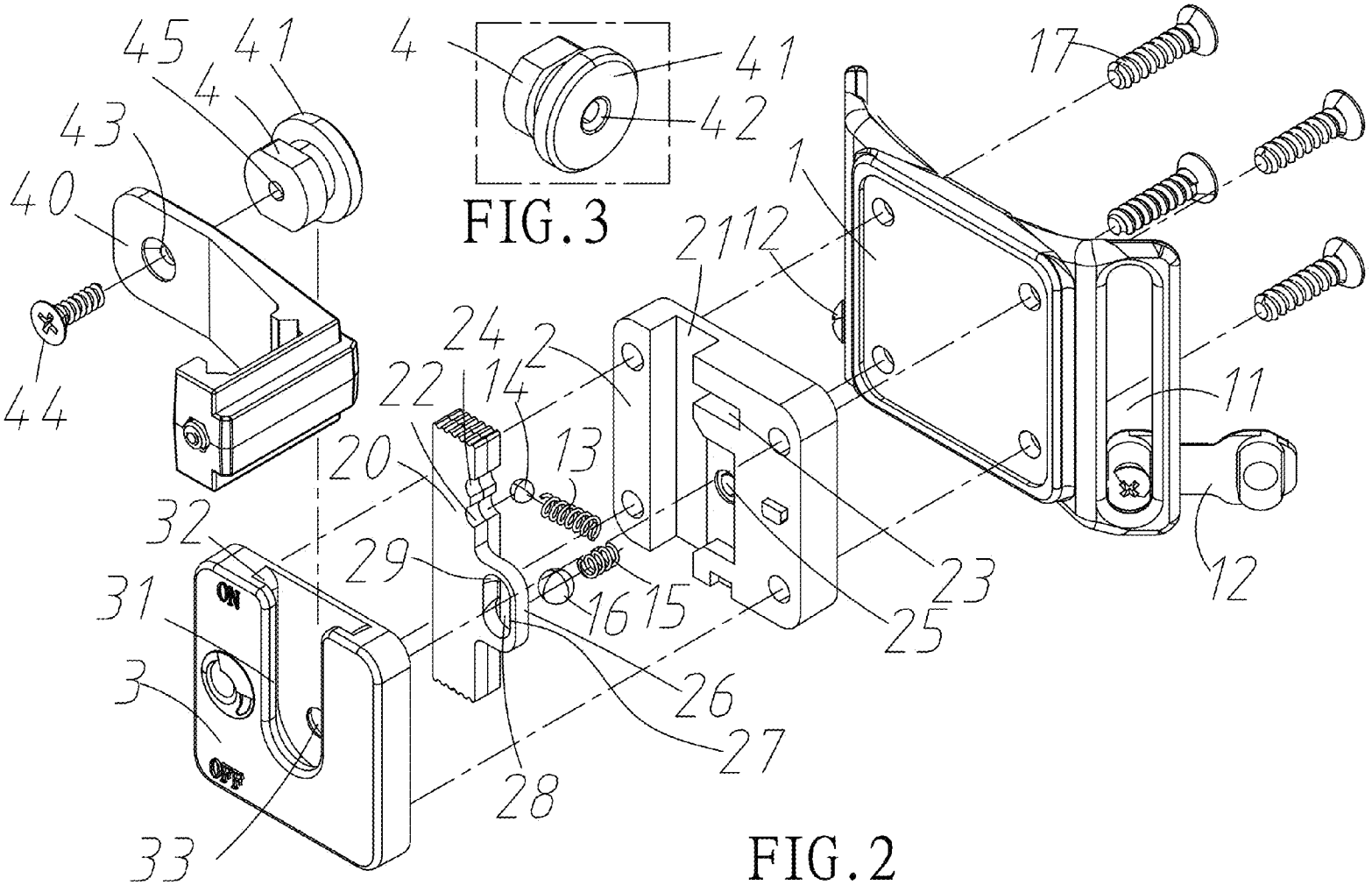
FIG. 2 is an exploded view of the quick release assembly.
Figure 4:
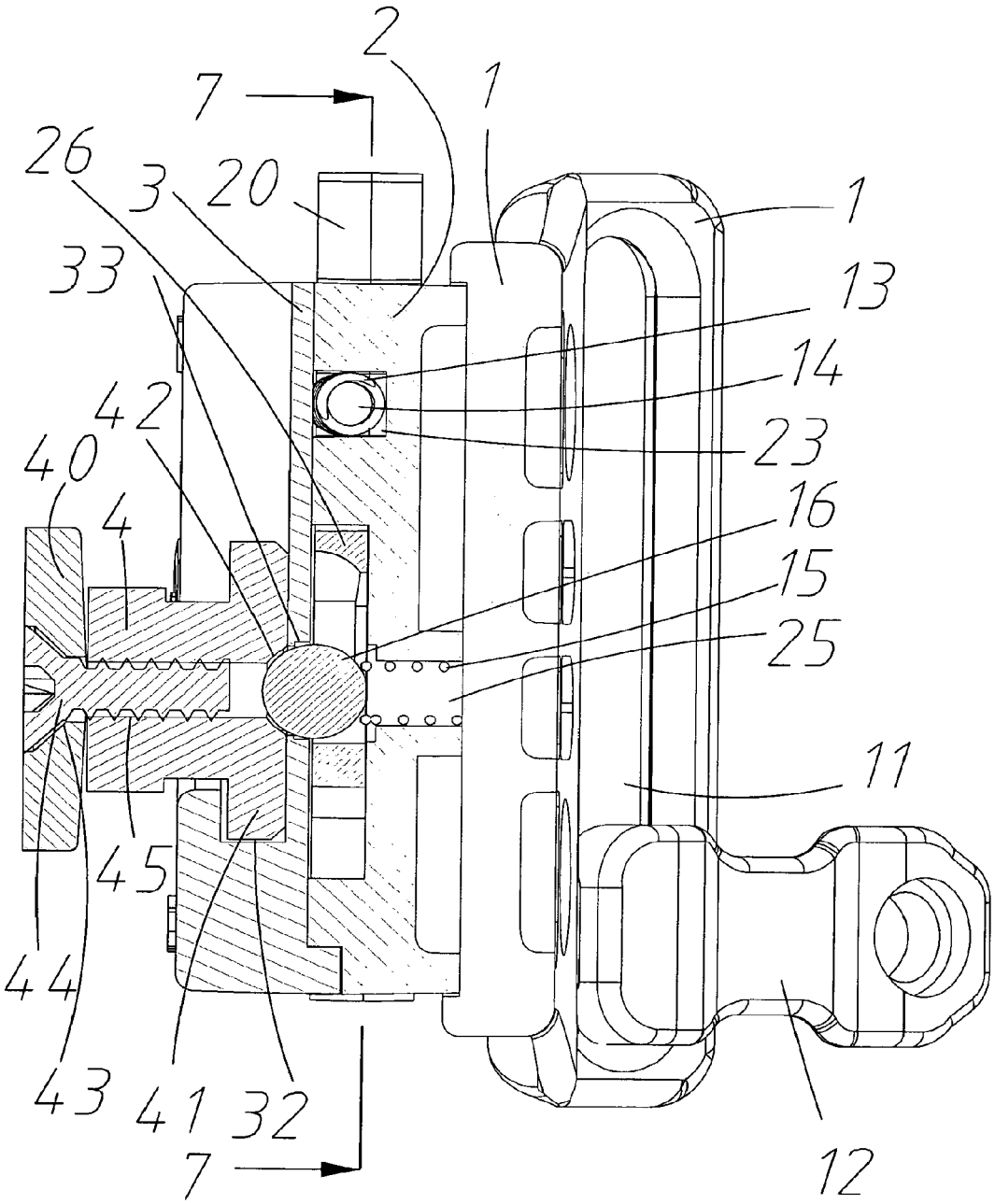
FIG. 4 is a side elevation in part section of FIG. 1.
Figure 5:
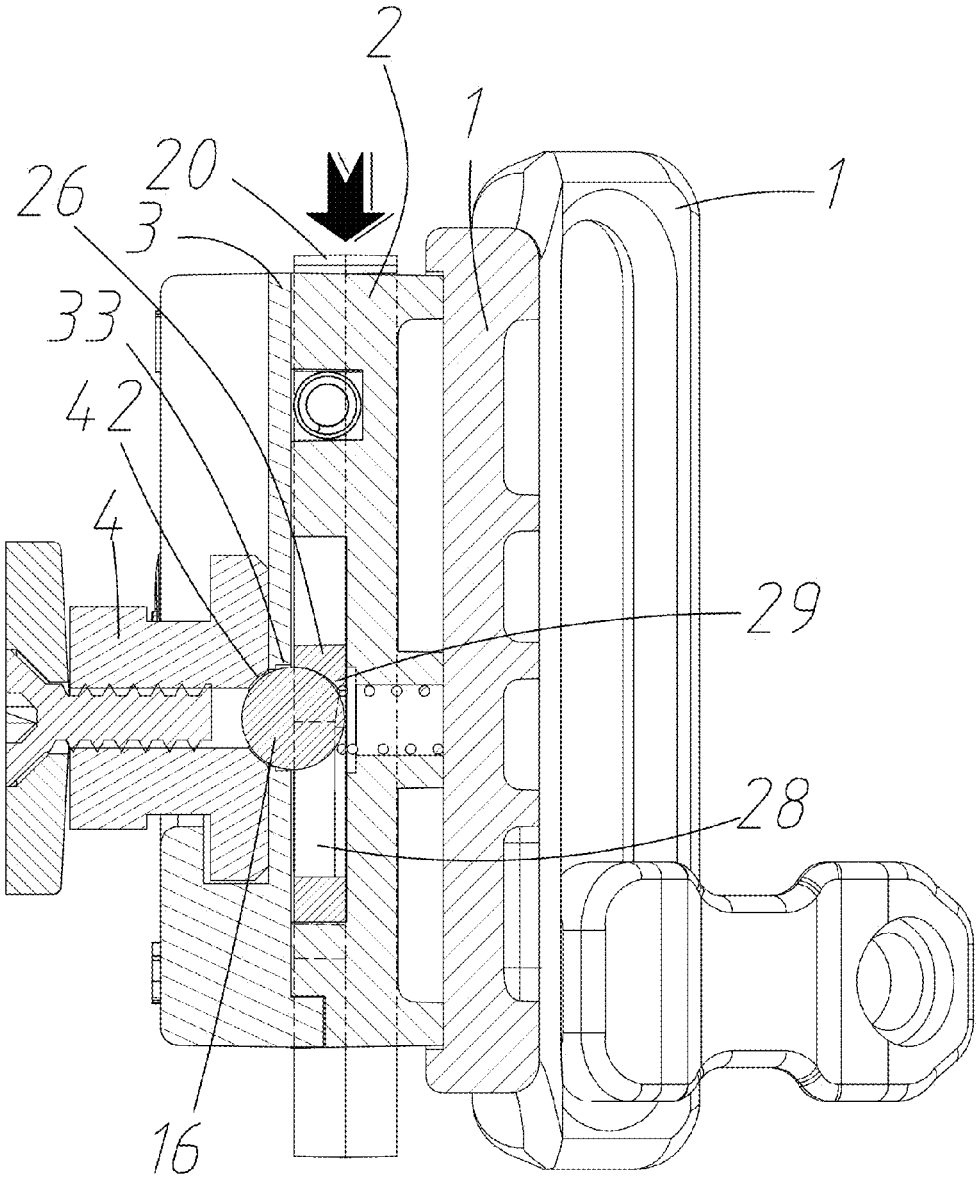
FIG. 5 is a view similar to FIG. 4 showing the shuttle being pushed down to lock the quick release assembly.
Figure 6:
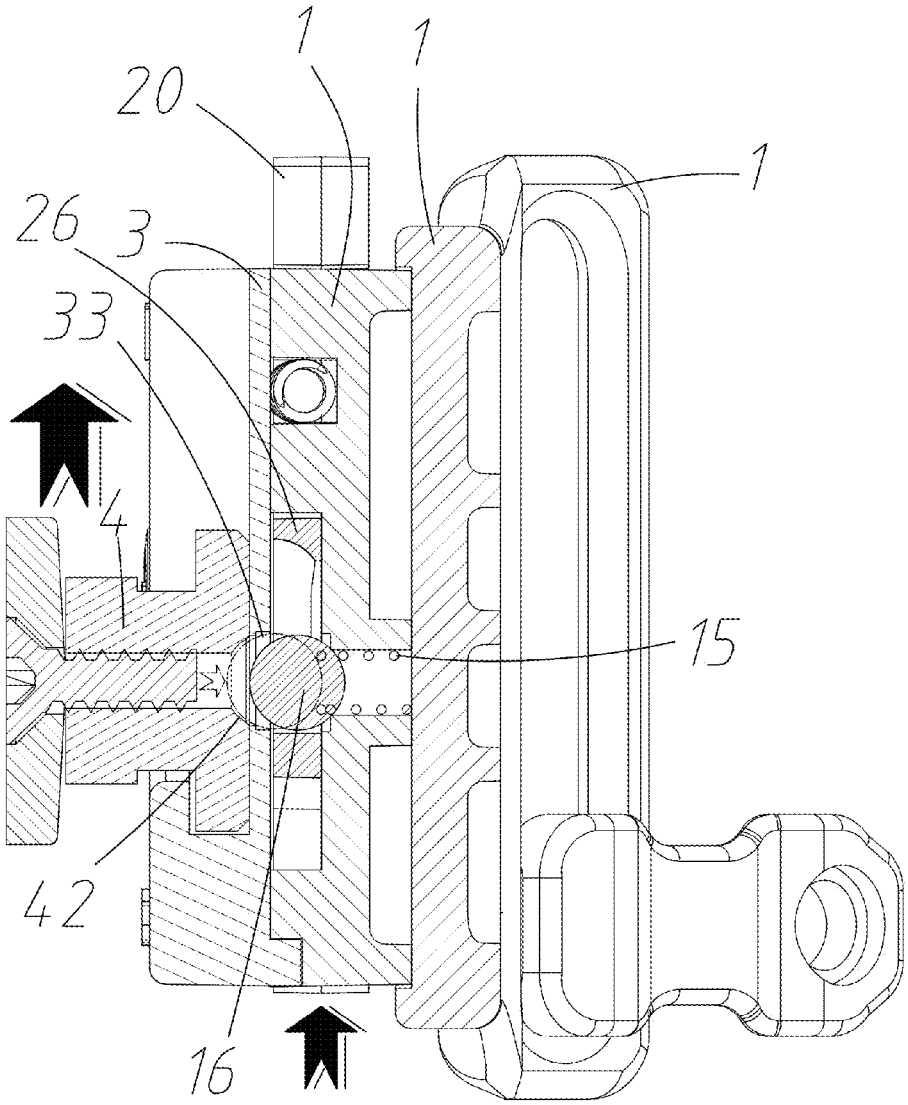
FIG. 6 is a view similar to FIG. 4 showing the shuttle being pushed up and the lock mechanism being pushed up to unlock the quick release assembly.

Referring to FIGS. 1 to 8, a quick release assembly in accordance with the invention comprises the following components as discussed in detail below.

A rectangular plate member 1 comprises two bent loops 11 at both ends respectively. A belt (not shown) (e.g., one worn on the torso of a law enforcement officer) can be inserted through the loops 11. Two slidable fasteners 12 each are adapted to slide in the loop 11 to fasten the belt so as to mount the quick release assembly thereon. A plurality of fasteners (e.g., four screws) 14 are driven through four corners of the plate member 1 and four corner of a rectangular inner plate 2 into four corner of a rectangular outer plate 3 to fasten the plate member 1, the inner plate 2, and the outer plate 3 together.

The inner plate 2 comprises a longitudinal channel 21 adjacent to one side, a lateral receptacle 23 communicating with the right side of the channel 21, a through hole 25 under the receptacle 23 communicating with the right side of the channel 21, and a shuttle 20 disposed in both the channel 21 and the through hole 25. A helical spring 13 has on end engaged with a blind end of the receptacle 23, and a steel ball 14 is urged by the other end of the spring 14. An upper tunnel 24 and a lower tunnel 22 are provided on one edge of the shuttle 20 in which one of the upper and lower tunnels 24, 22 is adapted to receive a portion of the steel ball 14. The through hole 25 has one end terminating at the back of the inner plate 2.

A helical spring 15 is disposed in the through hole 25 and has one end engaged with the a front surface of the plate member 1. A steel ball 14 has one end engaged with the other end of the spring 15 and is partially disposed in the through hole 25. The shuttle 20 further comprises a lug 26 under the lower tunnel 22, a slot 28 through the lug 25, a narrow through hole 29 on an upper portion of the slot 28, and a circular through hole 27 on a lower portion of the slot 28.

The outer plate 3 comprises a longitudinal recess 31 having two curved portions 32 on a top, and a through hole 33 having one end terminating at the back of the outer plate 3 and the other end terminating at the recess 31. A lock mechanism 4 is disposed in the recess 31 and comprises an axial threaded hole 45 through both ends, an annular flange 41 in the rear, a concave part 42 formed at one end of the hole 45 and in a central portion the flange 41, a separate lever 40, a hole 43 through one end of the lever 40, and a screw 44 driven through the hole 43 into the threaded hole 45 to rotatably secure the lever 40 to the lock mechanism 4.

Figure 8:
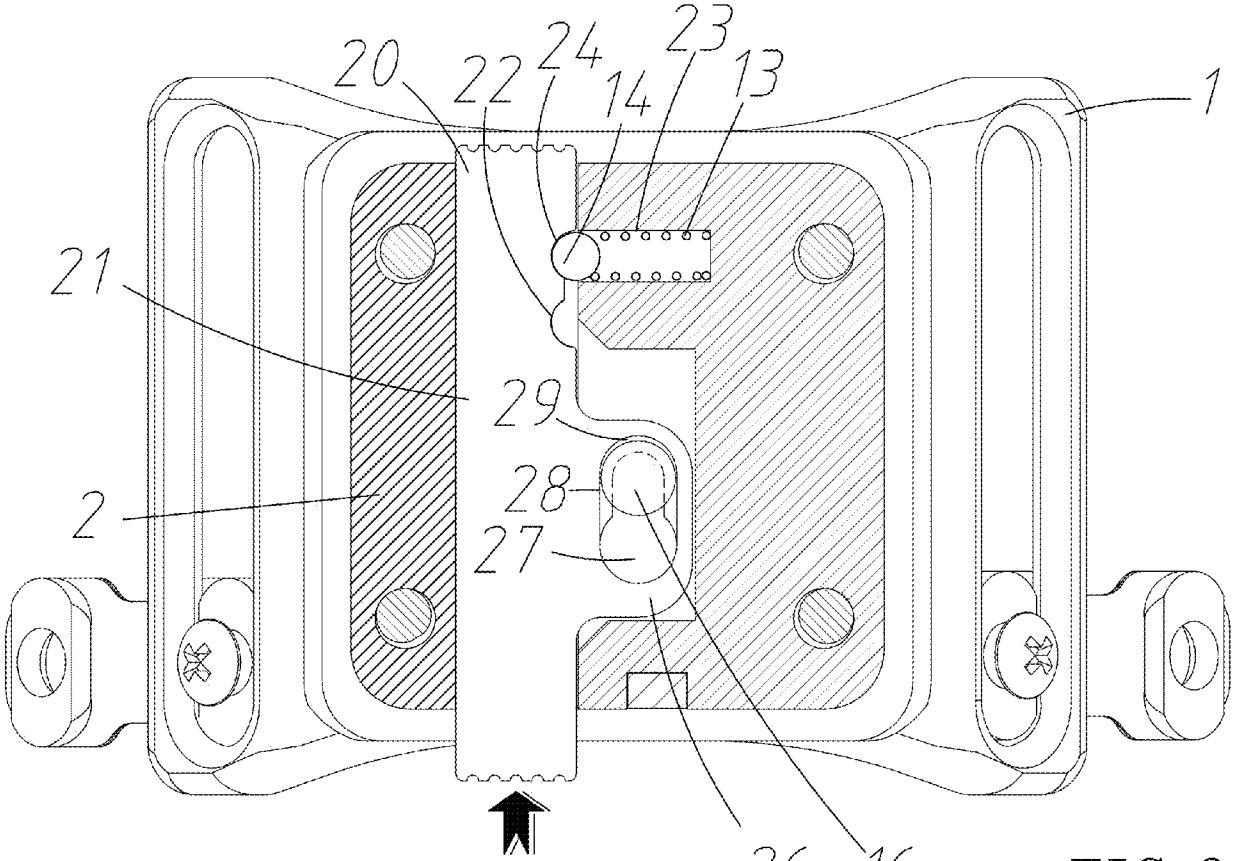
FIG. 8 is a view similar to FIG. 7 showing the shuttle being pushed up.

In a locked state, the steel ball 14 is in the upper tunnel 24 and the steel ball 16 is disposed in the through hole 29 (see FIG. 8). Also, the lever 40 (i.e., the lock mechanism 4) is locked. Further, a piece of law enforcement equipment such as a baton (not shown) is locked by the lever 40.

Figure 7:
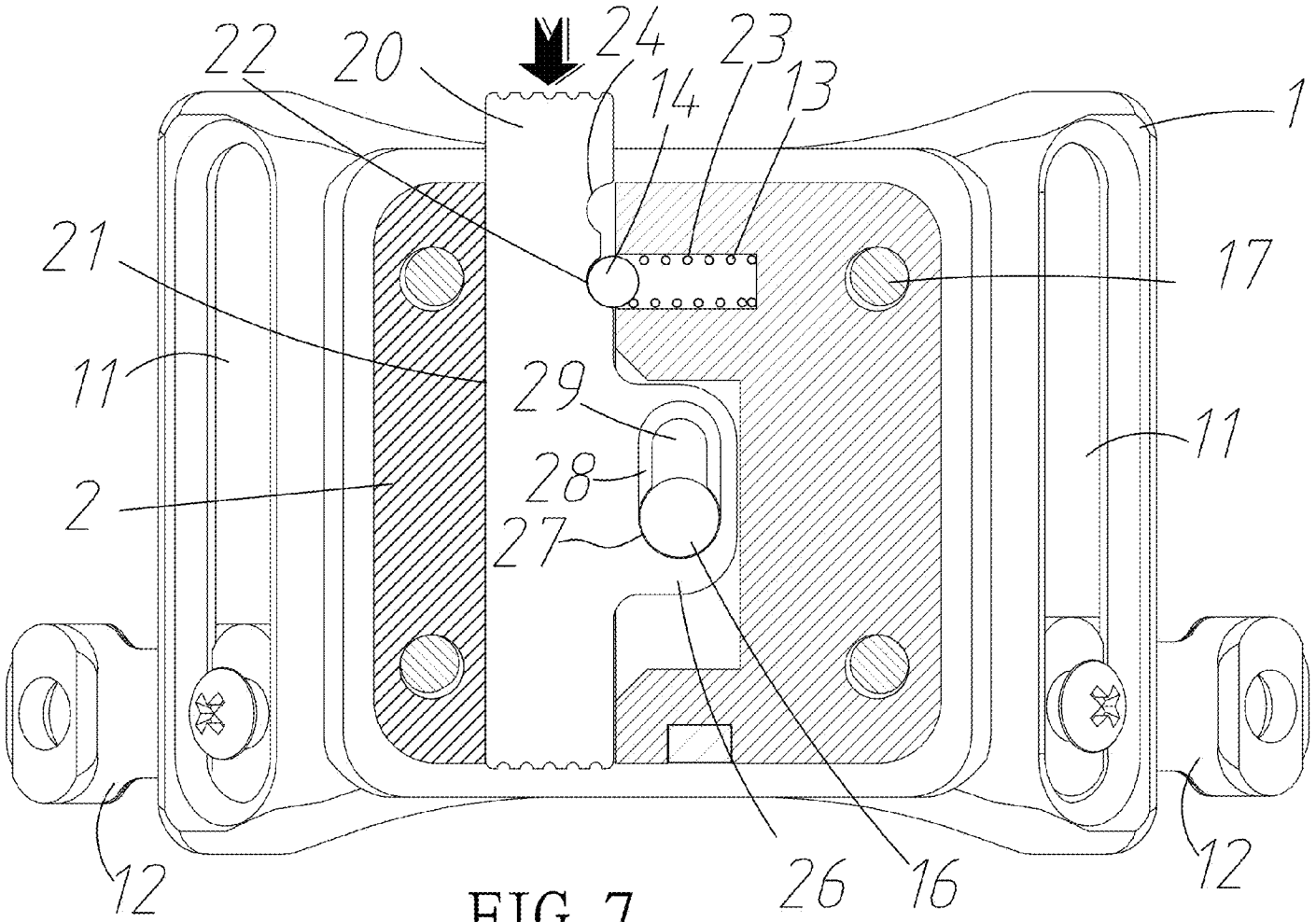
FIG. 7 is a front view in part section of the quick release assembly showing the shuttle being pushed down.

In an unlocking operation, a user (e.g., police) may press the bottom of the shuttle 20 upward until the lower tunnel 22 moves upward to receive the steel ball 14 and the through hole 27 moves upward to receive the steel ball 16 (see FIG. 7). Further, the user may push up the lever 40 to cause the concave part 42 to push the steel ball 16 inward (see FIG. 6). As a result, the lock mechanism 4 is unlocked. Therefore, the user may quickly bring a weapon such as a baton secured to the lock mechanism 4 into action.

It is envisaged by the invention that a push down of the shuttle 20 can lock the lock mechanism 4 (i.e., the quick release assembly) and to the contrary, a push up of the shuttle 20 can unlock the lock mechanism (i.e., the quick release assembly).

While the invention has been described in terms of preferred embodiments, those skilled in the art will recognize that the invention can be practiced with modifications within the spirit and scope of the appended claims.

What is claimed is:

1. A quick release assembly comprising:

a rectangular plate member comprising two bent loops at respective ends thereof;

a slidable fastener disposed in each loop;

a rectangular inner plate attached to the rectangular plate member, the rectangular inner plate comprising a longitudinal channel adjacent to one side of the rectangular plate member, a lateral receptacle communicating with the longitudinal channel, and a through hole under the lateral receptacle communicating with the longitudinal channel;

a shuttle moveably disposed in the longitudinal channel of the rectangular inner plate, the shuttle comprising an upper tunnel formed on an edge of the shuttle opposite to the lateral receptacle, a lower tunnel formed on an edge of the shuttle, under the upper tunnel, and opposite to the lateral receptacle, a lug under the lower tunnel and disposed in the through hole of the rectangular inner plate, a slot through the lug, the slot comprising a narrow hole on an upper portion of the slot, and a circular hole on a lower portion of the slot and communicating with the narrow hole;

a first spring actuated detent disposed in the lateral receptacle of the rectangular inner plate and having one end urging against either the upper tunnel or the lower tunnel of the shuttle;

a rectangular outer plate attached to the rectangular inner plate, the rectangular out plate comprising a longitudinal recess, and a hole member through the longitudinal recess and communicating with the slot of the shuttle and the through hole of the rectangular inner plate;

a lock mechanism removably disposed in the longitudinal recess and comprising a lever and a concave part facing the hole member of the rectangular outer plate and the slot of the shuttle; and a second spring actuated detent disposed in the through hole of the rectangular inner plate, the slot of the shuttle, the hole member of the rectangular outer plate, and the concave part of the lock mechanism;

wherein in a locked state, the first spring actuated detent is disposed in the upper tunnel of the shuttle and the second spring actuated detent is disposed in the narrow hole of the slot; and wherein in an unlocked state, the first spring actuated detent is disposed in the lower tunnel of the shuttle and the second spring actuated detent is disposed in the circular hole of the slot so that a pushing up of the lever of the lock mechanism causes the concave part to push the second spring actuated detent inward to unlock the lock mechanism.

* * * * *